US006656095B2

(12) United States Patent
Fernandez

(10) Patent No.: US 6,656,095 B2
(45) Date of Patent: Dec. 2, 2003

(54) APPARATUS FOR PERFORMING ABDOMINAL AND OTHER MUSCLE GROUP EXERCISES

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 0 days.

(21) Appl. No.: 10/174,004

(22) Filed: Jun. 18, 2002

(65) Prior Publication Data

US 2003/0119637 A1 Jun. 26, 2003

Related U.S. Application Data

(60) Provisional application No. 60/343,525, filed on Dec. 21, 2001.

(51) Int. Cl.[7] ..... A63B 26/00
(52) U.S. Cl. ..... 482/142
(58) Field of Search ..... 482/140, 142, 482/907–8, 122–6, 111–112, 148, 96–101, 130–133, 129, 121; 128/845–6; 297/284.7–8, 13, 14; 606/200

(56) References Cited

U.S. PATENT DOCUMENTS

| | | | | |
|---|---|---|---|---|
| 6,258,016 | B1 * | 7/2001 | Kuo | 482/142 |
| 6,283,900 | B1 * | 9/2001 | Tornabene | 482/122 |
| 6,371,896 | B1 * | 4/2002 | Kettler | 482/142 |
| 6,394,938 | B1 * | 5/2002 | Tornabene | 482/142 |
| 6,544,151 | B2 * | 4/2003 | Tornabene | 482/122 |

* cited by examiner

*Primary Examiner*—Nicholas D. Lucchesi
*Assistant Examiner*—L Amerson
(74) *Attorney, Agent, or Firm*—Lerner, David, Littenberg, Krumholz & Mentlik, LLP

(57) ABSTRACT

An apparatus for performing abdominal and other muscle group exercises is disclosed. The apparatus is comprised of a backrest, tracks, a base and a resistance member, which provides the user with an adjustable level of resistance when the apparatus is in use. The tracks of the apparatus are removeably attached to the backrest, and the resistance member is removeably attached to a base, thereby allowing the apparatus to be easy assembled and stored in a compact manner.

34 Claims, 11 Drawing Sheets

APPARATUS FOR PERFORMING ABDOMINAL AND OTHER MUSCLE GROUP EXERCISES

CROSS-REFERENCE TO RELATED APPLICATIONS

The present application claims priority from U.S. Provisional Application No. 60/343,525 filed Dec. 21, 2001, the disclosure of which is hereby incorporated by reference herein.

BACKGROUND OF THE INVENTION

The present invention relates to an apparatus for facilitating the conditioning or developing of a muscle or muscle group of the user by the user raising and lowering his/her upper body between a seated position and an upward facing prone position primarily by contraction of the muscle or muscle groups. Devices that facilitate such an exercise movement have gained increased popularity in recent years. Some of these devices function by the user sitting on the device and pushing backward or leaning forward on a back support that have semi-circular shaped tracks positioned on either side of the user that move in an arcuate motion when the user leans either forward or backward. These devices are normally used on a flat, horizontal surface such as a floor.

However, these devices generally lack a means of providing the user with positive and negative resistance when the user leans backward and forward. The lack of such resistance results in a less efficient workout requiring the user to complete a greater number of repetitions to achieve the desired abdominal muscle and other muscle group conditioning. Some devices do incorporate a means of resistance in the form of rubber band-like components of variable thickness and tension. These devices, however, require multiple resistance components that the user must manually remove and replace to either increase or decrease the resistance.

Additionally, such devices tend to be made of metal or made to be inflexible and bulky, which makes it difficult to store the device efficiently. Although these devices can be assembled, they are not designed to be regularly and easily disassembled after use for easy and compact storage.

An example of one such device is described in U.S. Pat. No. 6,283,900, issued to Tornabene. The apparatus disclosed by U.S. Pat. No. 6,283,900 includes semi-circular track members affixed to a backrest and rubber band-like tensioning members as a means of providing variable resistance.

SUMMARY OF THE INVENTION

An aspect of the present invention provides an apparatus for performing abdominal and other muscle group exercises. The apparatus according to this aspect of the invention desirably includes a piston or other expedient positioned behind a backrest and connected to a base that provides the apparatus with positive or negative resistance depending on whether the user is leaning forward or backward while using the apparatus. The position of the piston can be adjusted to change the level of resistance. Preferably, the base has three raised plastic studs, or other expedients, for mounting the piston or other expedient in different positions, thereby changing the resistance. Because the piston component is permanently affixed to the backrest, the user only needs to move the position of the piston or other expedient on the base to change the level of resistance or for storage of the apparatus in a flat, linear position. There are several advantages of using this design, including that the user gets a more efficient workout requiring less repetitions. Another advantage is that the user is not required to completely remove and replace a component of the apparatus to change the level of resistance.

Another aspect of the present invention provides a textured surface on the bottom portion of each member of the flexible tracks to prevent slippage during use.

Another aspect of the present invention provides flexible tracks on either side of the back support that provide the arcuate motion when the apparatus is in use. Said flexible tracks are comprised of individual members made of durable plastic and interconnected to allow flexibility between the arc-shaped position when the apparatus is in use and the linear position for easy storage. This configuration allows the apparatus to be easily stored in a flat, compact manner. The user can easily detach the flexible arch-shaped tracks by removing grip handles, loosening thumbscrews located through the flexible tracks and sliding said flexible tracks out and away from the backrest along a horizontal support member.

Another aspect of the present invention provides an adjustable headrest situated at the top of the backrest. The extension member of the headrest has slots so that a locking member situated on the backrest can lock the headrest in any number of positions. The advantage of this design is that users of different heights can use the apparatus by adjusting the position of the headrest.

Another aspect of the present invention provides handles positioned on either side of the upper portion of the backrest. The advantage of this design is to allow for easy lifting and transport of the apparatus in either the use position or the storage position.

These and other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENTS

Figure 1:
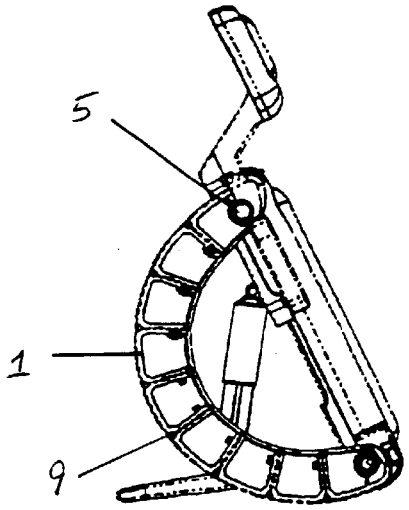
FIG. 1 is a right side view of the apparatus with the tracks in the locked position.
Figure 2:
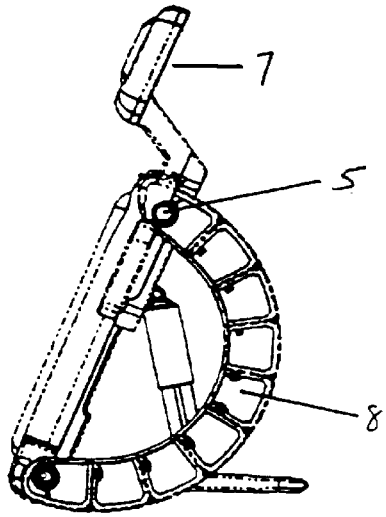
FIG. 2 is a left side view of the apparatus with the tracks in the locked position.
Figure 3:
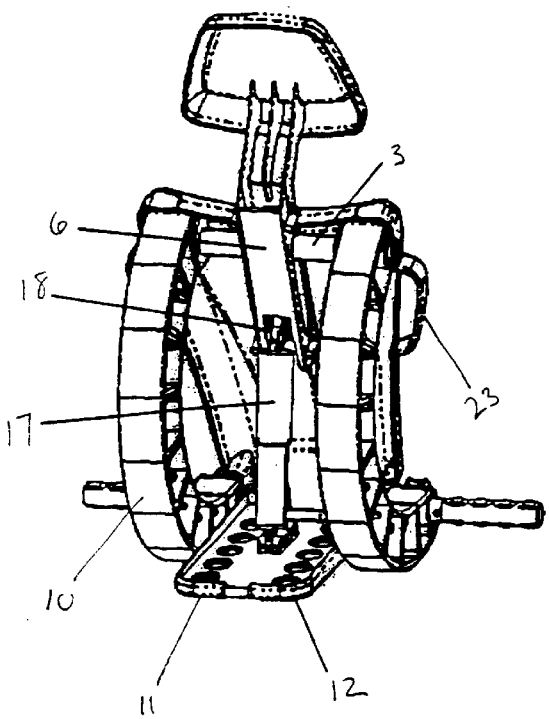
FIG. 3 is a rear perspective view with the tracks in the locked position.
Figure 4:
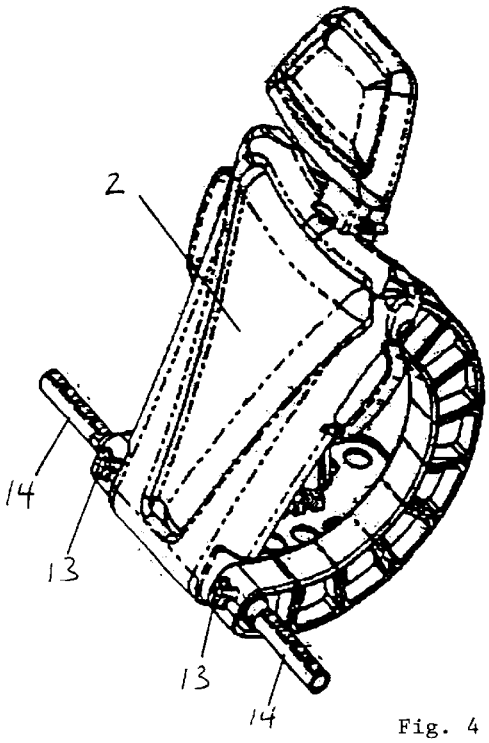
FIG. 4 is a right side elevation view from the front of the apparatus with the tracks in the locked position.
Figure 5:
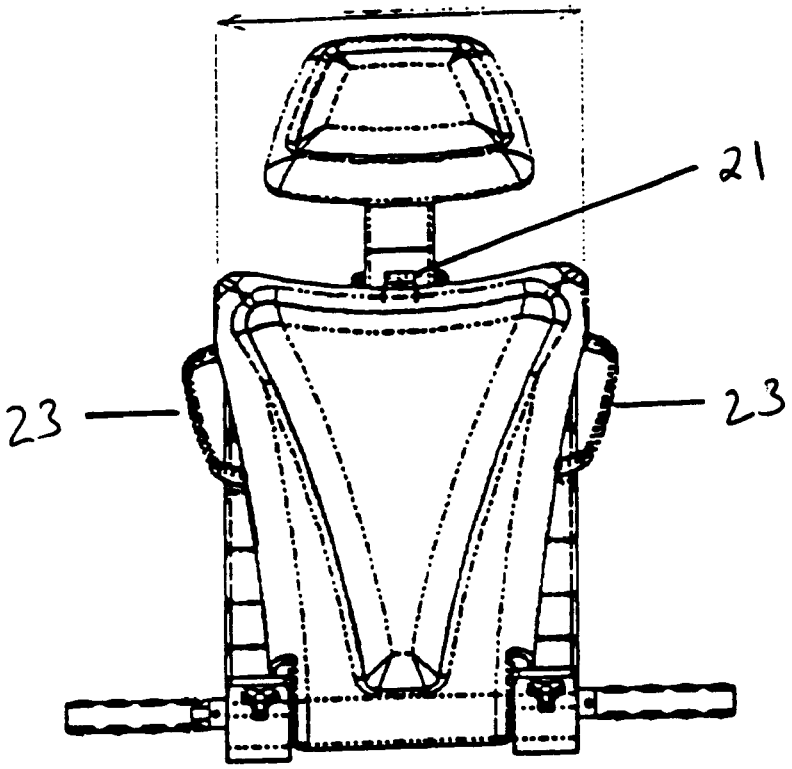
FIG. 5 is a front view of the apparatus with the tracks in the locked position.
Figure 6:
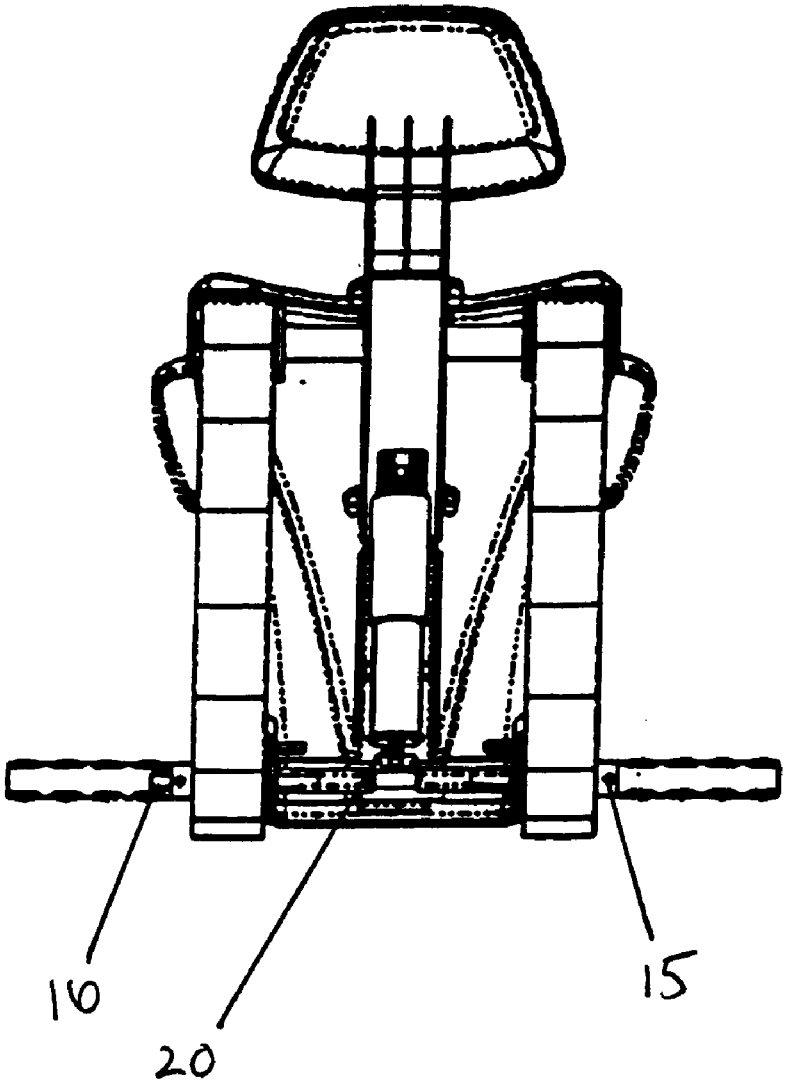
FIG. 6 is a rear view of the apparatus with the tracks in the locked position.

FIGS. 1–15 illustrate an embodiment of the invention. Like numbers refer to like elements throughout. In a preferred embodiment of the invention, all of the parts are made of durable plastic except for the connecting elements, which may be made of other materials including metal. An all-plastic or other lightweight material is also contemplated. This embodiment of the invention allows for the apparatus to be lightweight for easy lifting and maneuvering. Additionally, it is easier and less costly to manufacture the apparatus by using cheaper, less rigid plastic components as opposed to more expensive and rigid metal components.

The illustrated apparatus includes a track 1 that is connected to a backrest 2 at a first end by means of a track hinge 3 on the upper portion of the backrest 2 and at a second end by means of a horizontal support member 4 on the lower portion of the backrest 2. The track hinge 3 and horizontal support member 4 traverse through the track 1 by means of an orifice 5 located on both ends of the track 1. In a preferred embodiment of the apparatus, the track hinge 3 also traverses through the headrest support member 6 to provide additional support to the backrest 2 and headrest 7.

Figure 7:
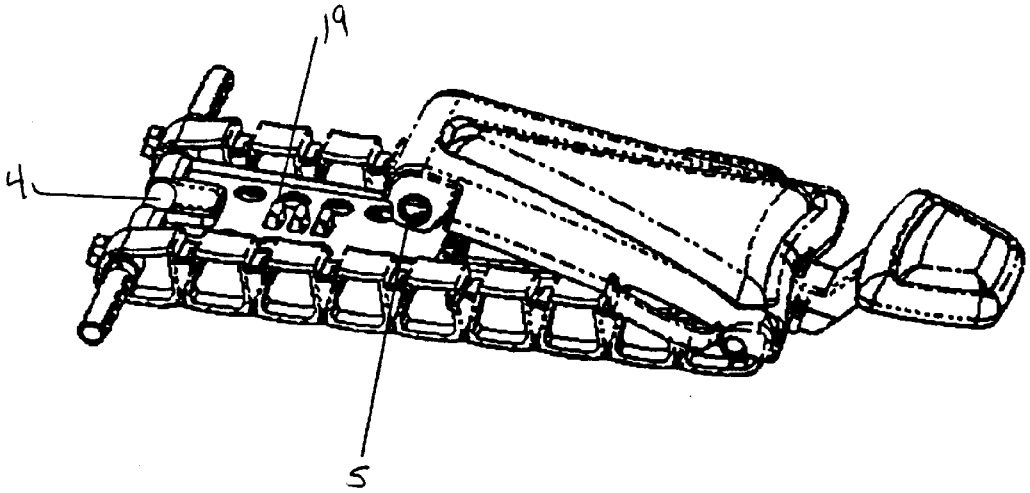
FIG. 7 is a right side elevation view of the apparatus in the storage position.
Figure 8:
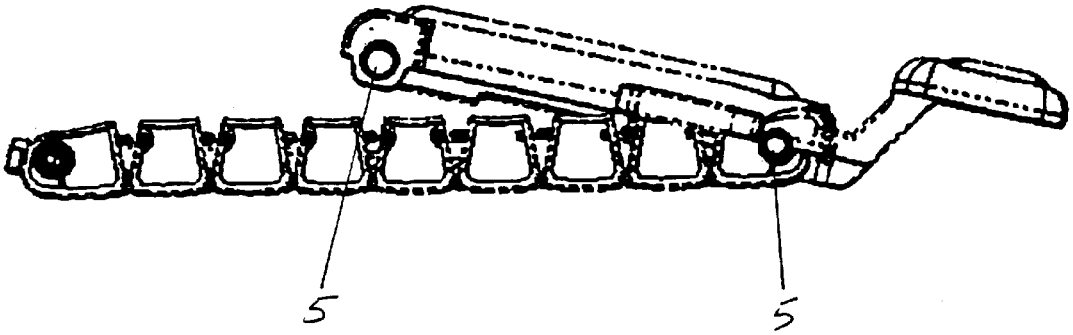
FIG. 8 is a right side view of the apparatus in the storage position.
Figure 9:
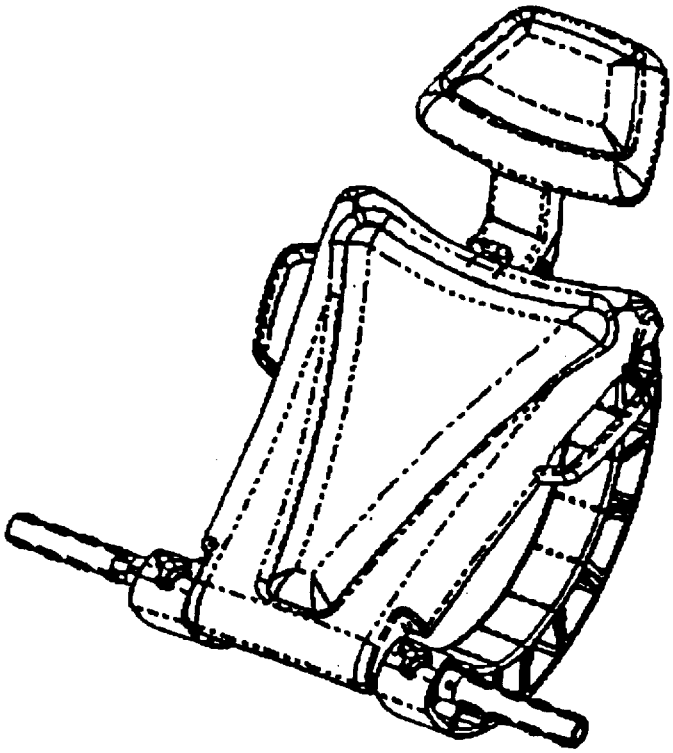
FIG. 9 is a front elevation view of the apparatus with the tracks in the locked position showing the headrest in the down position.
Figure 10:
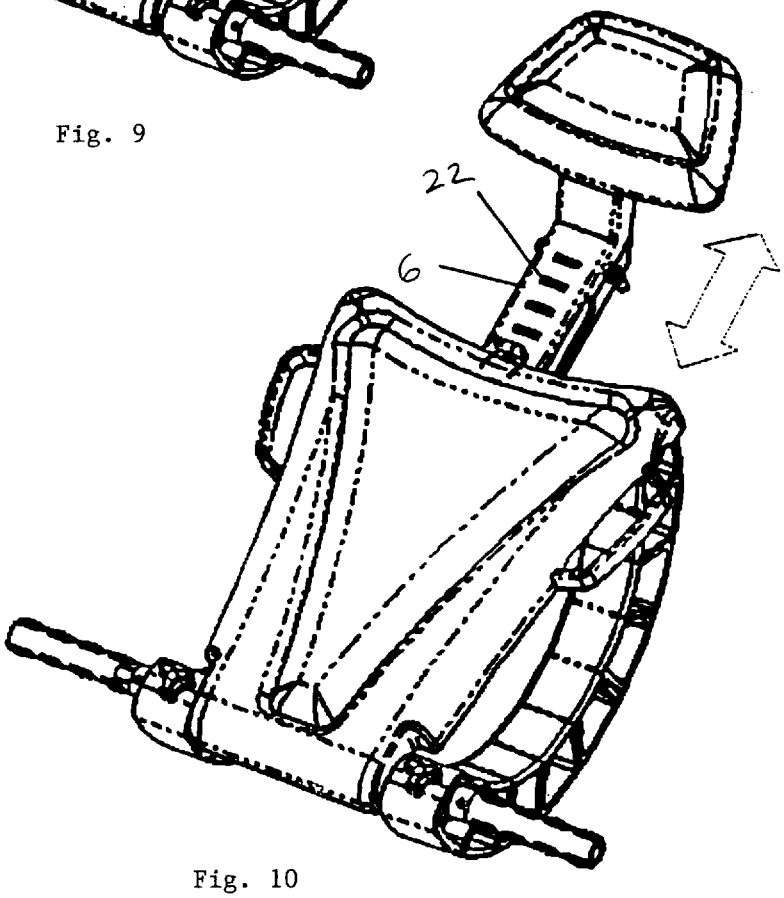
FIG. 10 is a front elevation view of the apparatus with the tracks in the locked position showing the headrest in an extended position.
Figure 11:
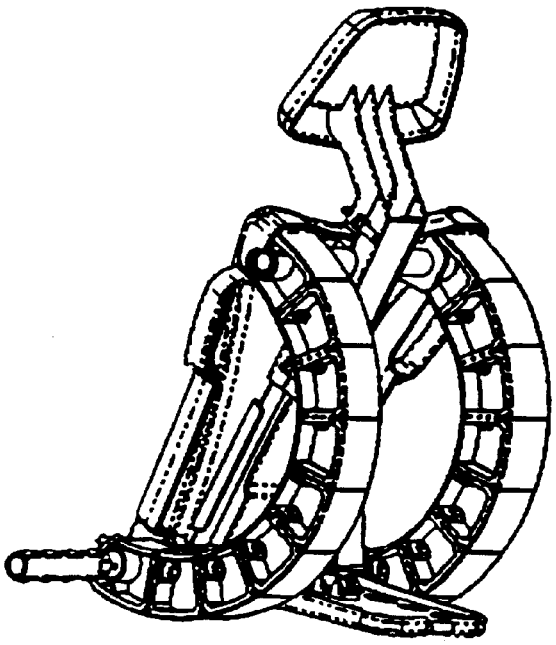
FIGS. 11 and 12 are rear perspective views of the apparatus in the upright position and inclined position, respectively.
Figure 12:
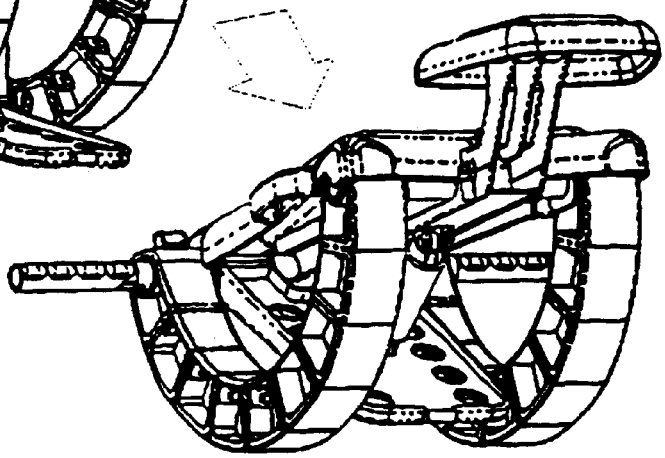

The track 1 is preferably composed of individual interlocking blocks 8 that allow the track 1 to take on an arc shape when in use, and when the track is disengaged from the lower portion of the backrest 2, to be stored in a flat, horizontal position as illustrated in FIGS. 7–8. In a preferred embodiment of the apparatus, the interlocking blocks 8 are connected together by either a plastic hinge (such as an integral "living hinge") or interlocked by means of a thick rib (male) connected to a hole (female). Each block has both a thick rib and a hole to allow for the connection. In another preferred embodiment of the apparatus, the interlocking blocks 8 are connected by means of a flexible, continuous base 9.

Preferably, textured treads 10 are attached to the bottom portion of track 1 to reduce slipping of the apparatus while in use. This advantage allows the apparatus to be used on a variety of flooring surfaces. Rubber grips may also be used to facilitate the gripping feature.

At least one roller 11 is preferably located on the base 12 thereby allowing the base 12 to easily slide along the floor when the apparatus is in use.

The track 1 can be disengaged from the horizontal support member 4 by loosening the thumbscrews 13 and pulling the grip handles 14 horizontally away from the horizontal support member 4. The grip handles 14 are held in place to the horizontal support member 4 by a detent 15 located on the grip handles 14 and a lock 16 on the horizontal support member 4.

The apparatus provides resistance when in use by reason of piston 17, which can provide resistance to compression by internal air or gas chambers (gas cylinder) or springs (spring cylinder), and be normally returnable to an elongate state. Alternatively, the piston 17 could be any expedient between the base 12 and the backrest 2 that provides the requisite resistance. An example of alternative expedients include springs or band-like tensioning members. The top end of the piston 17 is connected to the back of the backrest 2 by means of a hinge 18. The bottom end of the piston 17 is connected to the base 12 by means of one or more studs 19 positioned on the base 12 and a clasp 20 located on the bottom end of the piston 17. The user can change the resistance of the piston 17 by positioning the piston 17 on one of the studs 19 allowing for varying levels of resistance.

The headrest 7 is adjustable by means of sliding the headrest support member 6 in an up or down manner. The headrest 7 is locked into position by engaging a connector 21 affixed to the backrest 2 with slots 22 located on the headrest support member 6.

Figure 15:
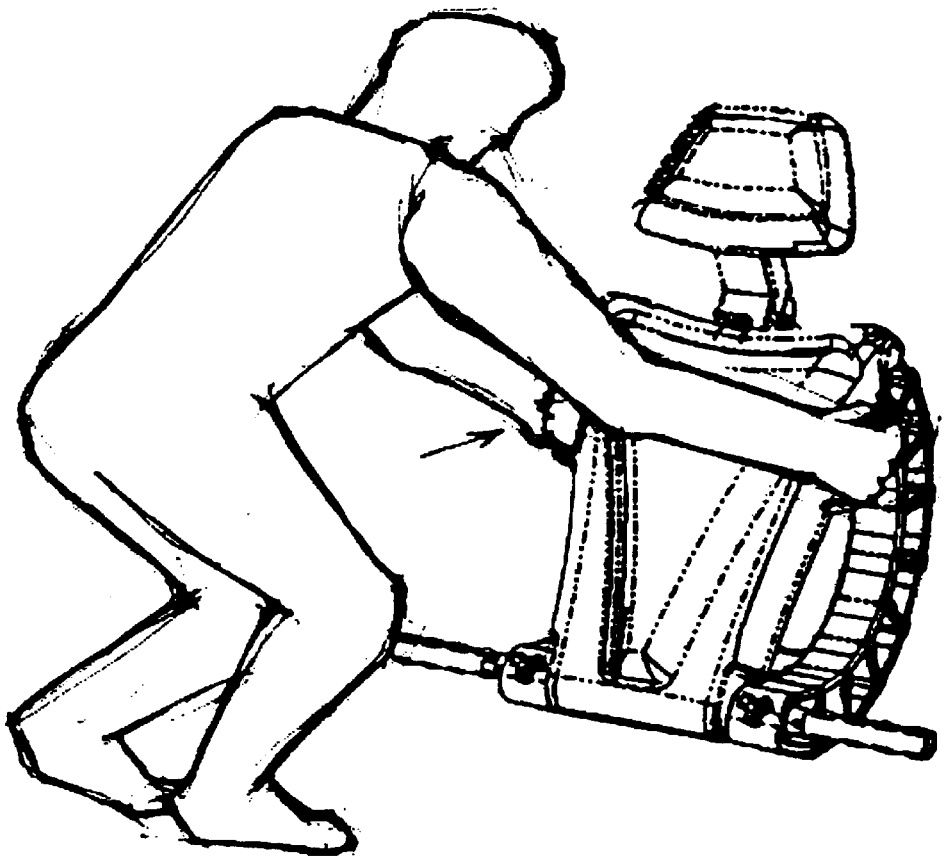
FIG. 15 is a front perspective view of the apparatus showing the apparatus in the upright position being maneuvered.

Handles 23 located on the backrest 2 allow the user to easily move the apparatus in either the use or storage position as shown in FIG. 15.

To assemble the apparatus for use, the thumbscrews 13 are loosened and the grip handles 14 are removed from the horizontal support member 4 by disengaging the detent 24 located on the grip handles 14 from the locking orifice 25 located on the horizontal support member 4. The track is then put into place and the grip handles slide through the orifice 5. The thumbscrews 13 are then tightened. Next, the piston 17 is attached to the one of the studs 19 located on the base 12 depending on the desired level of resistance. The headrest 7 can be adjusted for the user's height by sliding the headrest support member 6 in a vertical manner and locking the headrest support member 6 in place by engaging the connector 21 with one of the slots 22 located on the headrest support member 6.

Figure 13:
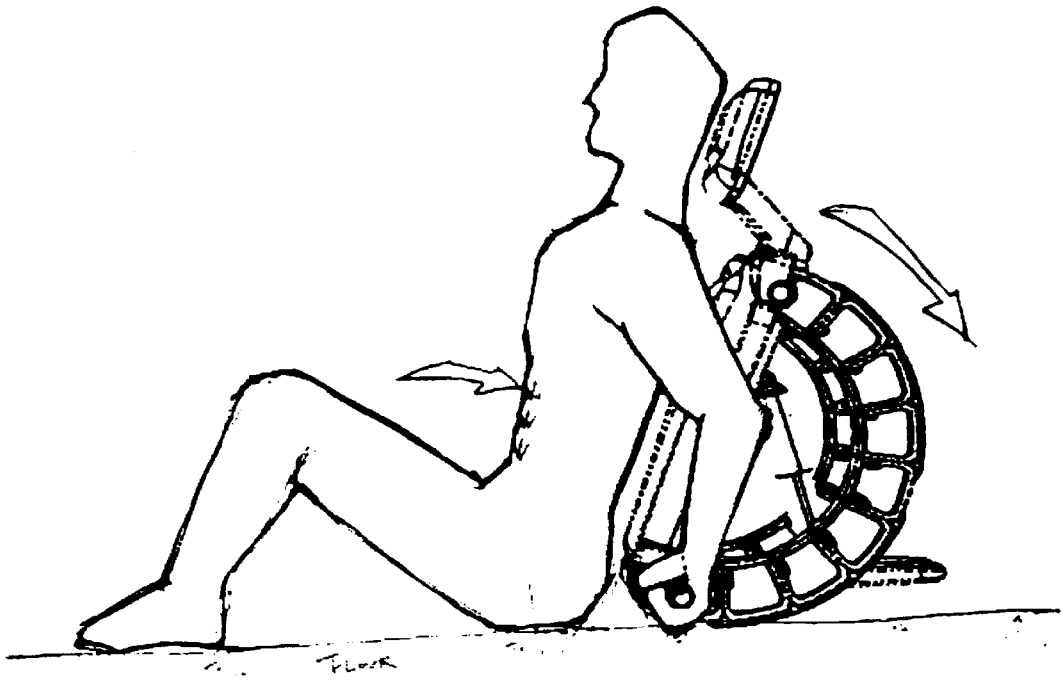
FIG. 13 is a right side view of the apparatus showing the apparatus in the upright position in use.
Figure 14:
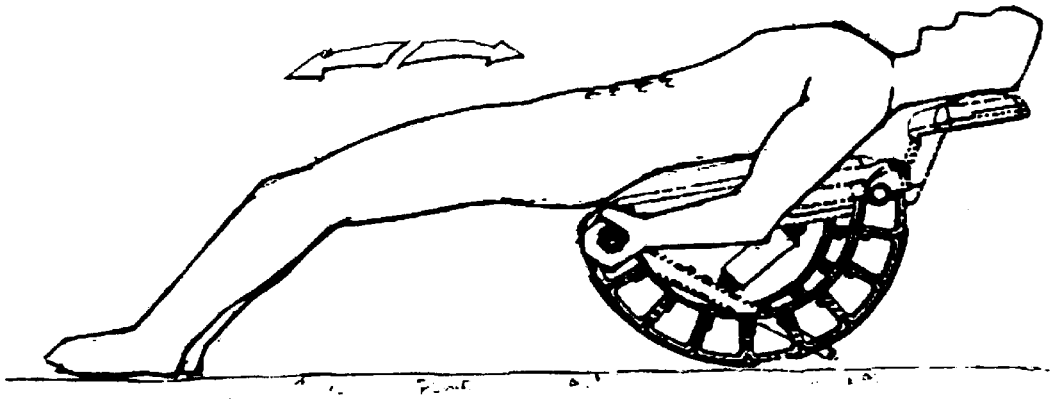
FIG. 14 is a right side view of the apparatus showing the apparatus in the inclined position in use.

In a seated position, the user leans back on the backrest 2 as illustrated in FIGS. 13–14. The apparatus then begins to rotate on the tracks 1 in an arcuate motion. The roller 11 on the base 12 then comes in contact with the floor surface thereby causing the piston 17 to compress providing resistance depending on the position of the piston 17 on the studs 19. As the user returns to the starting position, the piston 17 expands and the resistance is reduced.

For storage, the clasp 20 on the bottom portion of the piston 17 must be disengaged from the studs 19 located on the base 12. The thumbscrews 13 are then loosened, the grip handles 14 are removed and the tracks 1 can be separated from the backrest 2. The grip handles 14 are then put back in place and the thumbscrews 13 tightened. The backrest 2 can then fold down in a flat position for easy storage.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention herein.

What is claimed is:

1. An apparatus for performing muscle and muscle group exercises, said apparatus comprising:

a backrest having a front side and a back side;

at least one flexible track disposed for arrangement between a storage position and an exercise position, said flexible track having a first end attached at the back side of said backrest and a second end removeably attached to said backrest at a point remote from said first end such that said track is in the exercise position; and a base member pivotally attached at the back side of said backrest, wherein said apparatus is supported by said base member and said flexible track, wherein said backrest can be moved toward said base member to perform an exercise.

2. An apparatus according to claims 1, further comprising a resistance member disposed between said backrest and said base member for providing resistance to the movement of said backrest member toward said base member.

3. An apparatus according to claim 1, wherein said flexible track is arcuate in shape when in the exercise position and linearly flat when in the storage position.

4. An apparatus according to claim 1, wherein said flexible track is comprised of individual, interconnected blocks.

5. An apparatus according to claim 1, wherein said apparatus has two flexible tracks.

6. An apparatus according to claim 1, wherein said flexible track is covered with a non-slip material.

7. An apparatus according to claim 1, further comprising a horizontal support member attached to said backrest, said horizontal support having two terminal ends.

8. An apparatus according to claim 7, wherein said second end of said flexible track defines an orifice, and said flexible track is removeably attached to said horizontal support by coupling said terminal end of said horizontal support with said orifice.

9. An apparatus according to claim 1, further comprising a track hinge attached to said backrest, said track hinge having two terminal ends.

10. An apparatus according to claim 9, wherein said first end of said flexible track defines an orifice, and said flexible track is attached to said track hinge by coupling said terminal end of said track hinge with said orifice.

11. An apparatus according to claim 3, further defining a lock for locking said flexible track in the exercise position.

12. An apparatus according to claim 9, wherein said lock is a screw.

13. An apparatus according to claim 7, further comprising grip handles removeably attached to said terminal end of said horizontal support member by means of a detent located on said grip handle and a locking orifice located on said horizontal support member.

14. An apparatus according to claim 1, further comprising handles attached to said backrest for positioning said apparatus.

15. An apparatus according to claim 1, wherein said resistance member is a piston.

16. An apparatus according to claim 1, wherein said piston defines a first end attached to said backrest by a hinge and a second end removeably attached to said base member.

17. An apparatus according to claim 16, further comprising a clasp located on said second end of said resistance member and one or more studs positioned on said base member, wherein said piston is attached to said base member.

18. An apparatus according to claim 1, further comprising at least one roller on one end of said base member, and wherein the other end of said base member is pivotally attached to said backrest.

19. An apparatus according to claim 1, wherein said backrest further includes a headrest positioned at said top of said backrest, said headrest having a back side and a front side.

20. An apparatus according to claim 19, wherein said headrest further includes a support member for adjusting said headrest, said support member being slideably attached to said back side of said backrest.

21. An apparatus according to claim 20, wherein the height of said headrest is adjustable by sliding said support member vertically.

22. An apparatus according to claim 20, further comprising a connector located on said backrest and slots located on said support member, wherein said headrest is locked in place by engaging said connector with said slots.

23. An apparatus for performing muscle and muscle group exercises, said apparatus comprising:

a backrest having a front side and a back side;

at least one track having a first end attached to said backrest and a second end attached to said backrest at a point remote from said first end;

a base member pivotally attached at the back side of said backrest, wherein the apparatus is supported by said base member and said track, wherein said backrest can be moved toward said base member to perform an exercise; and a piston disposed between said backrest and said base member for providing resistance to the movement of said backrest toward said base member.

24. An apparatus according to claim 23, wherein said track is arcuate in shape.

25. An apparatus according to claim 23, wherein said apparatus has two tracks.

26. An apparatus according to claim 23, wherein said track is covered with a non-slip material.

27. An apparatus according to claim 23, further comprising grip handles attached to said backrest.

28. An apparatus according to claim 23, further comprising handles attached to said backrest for lifting and positioning said apparatus.

29. An apparatus according to claim 23, wherein said piston includes a first end attached to said backrest by a hinge and a second end attached to said base member, either or both of the ends being removeably attached to the respective backrest or base member.

30. An apparatus according to claim 29, further comprising a clasp located on said second end of said piston and one or more studs positioned on said base member, wherein said piston is attached to said base member.

31. An apparatus according to claim 23, further comprising at least one roller on one end of said base member.

32. An apparatus according to claim 23, wherein said backrest further includes a headrest positioned at said top of said backrest, said headrest having a back side and a front side.

33. An apparatus according to claim 32, wherein said headrest further includes a support member for adjusting said headrest, said support member being slideably attached to said back side of said backrest.

34. An apparatus according to claim 33, further comprising a connector located on said backrest and slots located on said support member, wherein said headrest is locked in place by engaging said connector with said slots.

* * * * *